United States Patent [19]

Katoh et al.

[11] 4,340,424

[45] Jul. 20, 1982

[54] FERRITIC STAINLESS STEEL HAVING EXCELLENT MACHINABILITY AND LOCAL CORROSION RESISTANCE

[75] Inventors: Koshi Katoh, Tsushima; Takayoshi Shimizu, Tokai, both of Japan

[73] Assignee: Daido Tokushuko Kabushiki Kaisha, Nagoya, Japan

[21] Appl. No.: 159,695

[22] Filed: Jun. 16, 1980

Related U.S. Application Data

[63] Continuation of Ser. No. 39,456, May 16, 1979, abandoned, which is a continuation of Ser. No. 888,395, Mar. 20, 1978, abandoned, which is a continuation of Ser. No. 737,411, Oct. 29, 1976, abandoned, which is a continuation-in-part of Ser. No. 554,140, Feb. 28, 1975, abandoned.

[30] Foreign Application Priority Data

Apr. 23, 1974 [JP] Japan ..... 49-45853
May 1, 1974 [JP] Japan ..... 49-49439

[51] Int. Cl.[3] ..... C22C 38/24; C22C 38/30

[52] U.S. Cl. ..... 75/126 E; 75/126 C; 75/126 G; 75/126 B; 75/126 M; 75/128 A; 75/128 E; 75/128 P; 75/128 V; 75/128 W; 148/37

[58] Field of Search ..... 75/126 E, 126 C, 126 H, 75/126 G, 126 M, 126 B, 126 L, 128 W, 128 A, 128 P, 128 E, 128 V; 148/37

[56] References Cited

U.S. PATENT DOCUMENTS

| | | | |
|---|---|---|---|
| 2,121,001 | 6/1938 | Arness | 75/126 M |
| 2,624,669 | 1/1955 | Crafts | 75/126 J |
| 2,703,661 | 3/1975 | Taylor | 75/126 J |
| 3,416,399 | 1/1975 | Denhard et al. | 75/126 L |
| 3,645,722 | 2/1972 | Aulenbach | 75/126 M |
| 3,846,186 | 5/1974 | Tipnis | 75/126 M |
| 3,852,063 | 12/1974 | Niimi et al. | 75/126 C |
| 3,856,515 | 12/1974 | Brandis et al. | 75/128 C |
| 3,895,940 | 7/1975 | Bieber et al. | 75/128 V |
| 3,932,175 | 1/1976 | Streicher et al. | 75/126 C |

*Primary Examiner*—Upendra Roy
*Attorney, Agent, or Firm*—Brisebois & Kruger

[57] ABSTRACT

Ferritic stainless steel having excellent machinability and local corrosion resistance comprises 21–30% chromium, less than 0.020% carbon, less than 0.050% nitrogen, 0.4–3.5% silicon, less than 3.0% manganese, 1.0–5.0% molybdenum, 0–3.0% vanadium, 0–5.0% nickel, and at least one element selected from the group consisting of 0.05–0.20% sulfur, 0.05–0.30% selenium, 0.05–0.30% tellurium, 0.01–0.20% lead, 0.01–0.20% bismuth and 0.005–0.065% calcium. When from 0.3–3.0% vandium is included the Si content should be 0.4–0.7%. When no vanadium is included the Si content should exceed 1% but not 3%.

4 Claims, 8 Drawing Figures

FERRITIC STAINLESS STEEL HAVING EXCELLENT MACHINABILITY AND LOCAL CORROSION RESISTANCE

This is a continuation of application Ser. No. 39,456, filed May 16, 1979, now abandoned; which was a streamline continuation of Ser. No. 888,395, filed Mar. 20, 1978, now abandoned; which was a streamline continuation of application Ser. No. 737,411, filed Oct. 29, 1976, now abandoned; which was a continuation-in-part of Ser. No. 554,140, filed Feb. 28, 1975, now abandoned.

FIELD OF THE INVENTION

The present invention relates to a high chromium ferritic stainless steel characterized by excellent resistance to local corrosions such as crevice and pitting corrosion and excellent machinability, which is suitable for use in making such articles as watch-cases, in which local corrosion poses a problem.

DESCRIPTION OF THE PRIOR ART

Generally speaking, stainless steels are widely used in chemical engineering and other applications calling for corrosion resistance. In such cases, austenitic stainless steel, notably an 18Cr-8Ni stainless steel is commonly used, but this steel, requiring a high nickel content, is expensive and at the same time inferior in stress corrosion cracking resistance and in resistance to local corrosion such as pitting.

On the other hand, ferritic stainless steel is generally inexpensive and excellent in stress corrosion cracking resistance, but inferior in general corrosion resistance to austenitic stainless steel. However, a ferritic stainless steel having a corrosion resistance equal to or higher than that of the austenitic stainless steel has been developed by increasing its chromium content and adding molybdenum. This ferritic stainless steel, however, becomes suddenly brittle when the chromium content exceeds 15% and, for this reason, a high chromium ferritic stainless steel with a chromium content of more than 20% has found no practical application. The major cause of this embrittlement is supposed to lie in the high carbon and nitrogen content. In recent years, with advances in melting technology, it has become possible to produce a high chromium ferritic stainless steel of excellent workability with reduced carbon and nitrogen contents, and as a result high chromium ferritic stainless steel has again come to receive public attention with various proposals made for its use.

As mentioned above, the workability of high chromium ferritic stainless steel has been improved by reducing the carbon and nitrogen content as the result of advances in melting technology, but no special attention has been paid to the machining that most steels have to undergo before they are finished into the final products. An attempt to improve the machinability of stainless steels by adding sulfur was made, but this method has found no widespread practical application, because it impairs the corrosion resistance.

SUMMARY OF THE INVENTION

The primary object of the present invention is to provide a high chromium ferritic stainless steel of excellent machinability. Another object of the present invention is to provide a high chromium ferritic stainless steel characterized by excellent resistance to local corrosions such as crevice corrosion and pitting. Still another object of the present invention is to provide a cheap stainless steel suitable for use in making watch-cases and the like.

These objects can be attained by a high chromium ferritic stainless steel containing less than 0.020% carbon, less than 0.050% nitrogen, 0.4–3.0% silicon, less than 3.0% manganese, 21–30% chromium, 1.0–5.0% molybdenum, 0–3.0% vanadium, 0–5.0% nickel, and at least one alloying element selected from the group consisting of 0.05–0.20% sulfur, 0.05–0.30% selenium, 0.05–0.30% tellurium, 0.01–0.20% lead, 0.01–0.20% bismuth, and 0.005–0.065% calcium, the balance being substantially all iron.

DETAILED DESCRIPTION OF PREFERRED EMBODIMENTS

Figure 1:
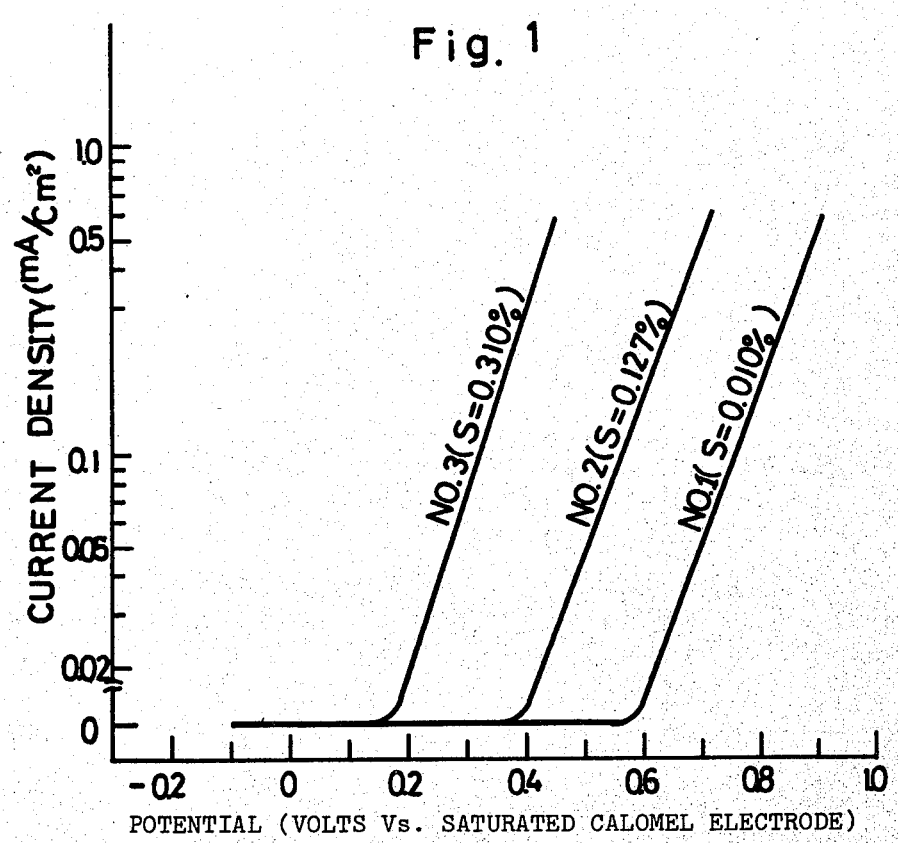
FIGS. 1–7 show anodic polarization curves for test specimens containing synthetic crevices in a 3% sodium chloride solution (35° C.).

The reasons for specifying the chemical composition of a ferritic stainless steel having excellent machinability and local corrosion resistance according to the present invention are as follows:

(1) Carbon less than 0.020%, nitrogen less than 0.050%

These are strong austenite-formers which impair the workability and corrosion resistance, but less than 0.020% carbon and less than 0.050% nitrogen will not adversely affect these properties of steel.

(2) Silicon 0.4–3.0%

This element is a ferrite-former which improves the local corrosion resistance through synergistic interaction with molybdenum or molybdenum and vanadium, but a large addition of silicon will impair the toughness of the steel. Therefore, when no vanadium is added, the content of silicon should, depending on the content of molybdenum, exceed 1% but not 3.0%, and lie preferably between 1.0 and 2.0%. When vanadium is added, the desirable content of silicon is in the range of 0.4–0.7%.

(3) Manganese less than 3.0%

This is an element which improves machinability through reaction with sulfur and is effective for eliminating hot shortness in steel. However, as it is an austenite-former and has an affinity to nitrogen, its content is specified as less than 3.0%.

(4) Chromium 21–30%

This is a ferrite-former and at the same time an essential alloying element for increased corrosion resistance, but too much of it impairs the workability. Thus an appropriate content of it consistent with both workability and corrosion resistance is 21–30%, preferably 23–28%.

(5) Molybdenum 1–5.0%

This too is a ferrite-former. Since it is effective in improving the corrosion resistance, notably the crevice corrosion resistance and the pitting resistance, it should be included in the amount of at least 1%, but the addition of more than 5.0% is not desirable due to its adverse effect on workability. More than 5.0% is unnecessary in a steel having the specified chromium and carbon content. Thus the appropriate range for its content is specified as 1.0–5.0%, preferably 1.0–4.0%.

(6) Vanadium 0–3.0%

This is a strong ferrite-former capable of increasing the toughness of steel. Together with molybdenum and silicon, it is effective in improving the local corrosion resistance, but a large quantity of it is unnecessary in a steel having the specified chromium and molybdenum content. Thus the effective content of vanadium in synergistic interaction with 0.4–0.7% silicon and 1.0–5.0% molybdenum would be 0.3–3.0%, and preferably 0.5–2.0%. If the steel contains 1.0–3% Si, the vanadium may be omitted.

(7) Nickel 0–5.0%

This element increases the general corrosion resistance and the hot strength of steel. Since it is a strong austenite-former, and an expensive element, it should be added in an amount less than 5.0%, depending on the intended use of the steel.

(8) Sulfur 0.05–0.20% selenium 0.05–0.3%, tellurium 0.05–0.3%, lead 0.01–0.20%, bismuth 0.01–0.20% and calcium 0.005–0.065%.

Sulfur, selenium and tellurium, which combine mainly with manganese, form non-metallic inclusions dispersed in the steel, which contribute to the improvement of the machinability of the steel. Lead and bismuth, which are dispersed in the steel as fine metal grains, also improve the machinability of the steel. When too much of these alloying elements is added, they are likely to impair the hot workability and corrosion resistance of the steel. When calcium is also added to the steel, it leaves deposits on the tool surface during high-speed cutting with a cemented carbide steel, thereby retarding the tool abrasion and prolonging the tool life, whereas in low-speed cutting the effect is not so great. Furthermore, too much calcium increases the amount of non-metallic inclusions in the steel, resulting in a deterioration in the corrosion resistance. For these reasons, at least one of these alloying elements should be added in an amount within the specified range.

As described above, the steel according to the invention is a high chromium ferritic stainless steel characterized by excellence in machinability and corrosion resistance, and particularly in resistance to local corrosions such as crevice corrosion and pitting. Moreover, it has a satisfactory stress corrosion cracking resistance and, in view of its having a low carbon content, it is sufficiently workable and weldable. Thus the steel according to the present invention is suitable for such applications as the manufacture of watch-cases, which must be resistant to local corrosion.

The features of the present invention will be more apparent from the following representative embodiment.

EXAMPLE

No restriction is imposed on the method of producing the steel according to the invention, so long as the desired additions of the above-mentioned alloying elements are made, but in this example, the melting and refining of steel was carried out by using a plasma arc induction melting furnace.

Stainless steels with the chemical compositions listed in Table 1 were melted, cast and forged at 1150° C. and then annealed at 820° C. Steel No. 23 (AISI316) was forged at 1200° C. and then annealed at 1100° C.

TABLE 1

| | C | N | Si | Mn | P | S | Cr | Mo | V | Ni | Other | Remark |
|---|---|---|---|---|---|---|---|---|---|---|---|---|
| 1 | 0.008 | 0.028 | 0.21 | 0.36 | 0.014 | 0.010 | 25.96 | 1.13 | — | — | — | |
| 2 | 0.007 | 0.034 | 0.28 | 0.25 | 0.018 | 0.127 | 26.11 | 0.98 | — | — | — | |
| 3 | 0.008 | 0.031 | 0.28 | 0.24 | 0.017 | 0.310 | 26.20 | 1.02 | — | — | — | |
| 4 | 0.008 | 0.025 | 0.99 | 0.26 | 0.016 | 0.125 | 26.33 | 0.99 | — | — | — | |
| 5 | 0.008 | 0.033 | 0.89 | 0.65 | 0.018 | 0.156 | 26.02 | 3.12 | — | — | — | |
| 6 | 0.009 | 0.036 | 0.98 | 0.56 | 0.017 | 0.147 | 26.10 | 4.96 | — | — | — | |
| *7 | 0.008 | 0.028 | 2.98 | 0.27 | 0.016 | 0.126 | 26.20 | 1.02 | — | — | — | |
| 8 | 0.010 | 0.030 | 3.53 | 0.27 | 0.016 | 0.128 | 26.13 | 1.12 | — | — | — | |
| *9 | 0.007 | 0.029 | 2.87 | 0.27 | 0.016 | 0.130 | 26.25 | 3.21 | — | — | — | |
| 10 | 0.009 | 0.036 | 0.92 | 0.31 | 0.018 | 0.012 | 26.08 | 1.05 | — | — | — | |
| 11 | 0.010 | 0.027 | 0.95 | 0.32 | 0.015 | 0.142 | 26.13 | 2.05 | — | — | — | |
| 12 | 0.00 | 0.027 | 0.96 | 0.34 | 0.017 | 0.246 | 26.03 | 0.96 | — | — | — | |
| *13 | 0.009 | 0.031 | 1.33 | 0.35 | 0.014 | 0.133 | 25.89 | 1.08 | — | — | — | |
| 14 | 0.008 | 0.030 | 0.98 | 0.30 | 0.014 | 0.140 | 26.11 | 0.41 | — | — | — | |
| *15 | 0.007 | 0.026 | 1.03 | 0.35 | 0.013 | 0.039 | 26.09 | 3.05 | — | — | Se = 0.21 | |
| *16 | 0.010 | 0.028 | 1.08 | 0.36 | 0.018 | 0.011 | 26.07 | 3.04 | — | — | Pb = 0.11 | |
| | | | | | | | | | | | | (%) |
| *17 | 0.008 | 0.029 | 1.05 | 0.29 | 0.015 | 0.009 | 26.03 | 3.08 | — | — | Ca = 0.023 | |
| *18 | 0.009 | 0.030 | 1.07 | 0.36 | 0.013 | 0.130 | 25.92 | 1.03 | — | 0.53 | — | |
| 19 | 0.010 | 0.024 | 0.97 | 0.32 | 0.014 | 0.129 | 25.88 | 1.09 | — | 3.03 | — | |
| 20 | 0.007 | 0.026 | 0.96 | 0.39 | 0.018 | 0.141 | 26.04 | 2.96 | — | — | Fe = 0.15 | |
| *21 | 0.009 | 0.025 | 1.03 | 0.32 | 0.014 | 0.139 | 25.96 | 3.03 | — | — | Si = 0.08 | |
| 22 | 0.008 | 0.031 | 0.68 | 0.28 | 0.014 | 0.138 | 26.09 | 1.11 | — | — | — | |
| 23 | 0.080 | 0.068 | 0.64 | 1.56 | 0.031 | 0.011 | 17.05 | 2.26 | — | 12.05 | — | AISI316 |
| *24 | 0.009 | 0.028 | 1.12 | 0.56 | 0.013 | 0.163 | 26.26 | 3.02 | 0.98 | — | — | |
| *25 | 0.008 | 0.029 | 0.45 | 0.66 | 0.017 | 0.156 | 26.55 | 3.08 | 1.11 | — | — | |
| *26 | 0.009 | 0.026 | 0.51 | 0.62 | 0.018 | 0.145 | 26.31 | 3.10 | 2.96 | — | — | |
| 27 | 0.009 | 0.025 | 0.28 | 0.31 | 0.016 | 0.148 | 26.08 | 3.07 | 1.08 | — | — | |
| *28 | 0.008 | 0.027 | 0.52 | 0.35 | 0.016 | 0.151 | 26.12 | 3.03 | 0.31 | — | — | |
| *29 | 0.007 | 0.034 | 0.47 | 0.29 | 0.017 | 0.146 | 26.05 | 3.06 | 2.03 | — | — | |
| 30 | 0.009 | 0.031 | 0.48 | 0.30 | 0.015 | 0.009 | 25.96 | 3.01 | 1.09 | — | — | |
| *31 | 0.008 | 0.032 | 0.54 | 0.26 | 0.014 | 0.144 | 26.06 | 2.05 | 1.12 | — | — | |
| 32 | 0.007 | 0.033 | 0.51 | 0.27 | 0.017 | 0.148 | 26.03 | 0.98 | 1.08 | — | — | |
| 33 | 0.008 | 0.030 | 0.49 | 0.28 | 0.018 | 0.150 | 25.98 | 0.42 | 1.03 | — | — | |
| *34 | 0.008 | 0.030 | 0.65 | 0.33 | 0.015 | 0.149 | 26.03 | 3.10 | 1.11 | — | — | |
| *35 | 0.009 | 0.028 | 0.53 | 0.29 | 0.015 | 0.146 | 26.05 | 4.38 | 1.04 | — | — | |
| 36 | 0.010 | 0.031 | 0.52 | 0.31 | 0.014 | 0.253 | 25.97 | 3.05 | 1.10 | — | — | |
| *37 | 0.008 | 0.035 | 0.49 | 0.42 | 0.018 | 0.028 | 26.08 | 2.95 | 1.05 | — | Se = 0.19 | |
| *38 | 0.008 | 0.029 | 0.51 | 0.43 | 0.018 | 0.009 | 26.03 | 2.98 | 0.98 | — | Pb = 0.13 | |
| *39 | 0.007 | 0.024 | 0.52 | 0.40 | 0.017 | 0.009 | 25.95 | 3.05 | 0.95 | — | Ca = 0.023 | |
| *40 | 0.009 | 0.028 | 0.50 | 0.41 | 0.014 | 0.147 | 26.11 | 3.02 | 1.08 | 2.48 | — | |

TABLE 1-continued

| | C | N | Si | Mn | P | S | Cr | Mo | V | Ni | Other | Remark |
|---|---|---|---|---|---|---|---|---|---|---|---|---|
| *41 | 0.010 | 0.030 | 0.51 | 0.38 | 0.016 | 0.015 | 26.13 | 2.95 | 1.02 | — | Te = 0.18 | |
| *42 | 0.011 | 0.033 | 0.51 | 0.42 | 0.013 | 0.014 | 26.02 | 3.11 | 0.96 | — | Bi = 0.08 | |

(*are steels according to the present invention)

For the purpose of investigating the crevice corrosion resistance of these steels, test specimens containing synthetic crevices were used. They were immersed in a 3% sodium chloride solution (at 35° C.) to obtain anodic polarization curves. The results are summarized in FIGS. 1–7.

FIG. 1 illustrates the effect of the addition of sulfur to a 26 Cr-1 Mo ferritic stainless steel on its anodic polarization curve. As seen from FIG. 1, the addition of sulfur to the 26 Cr-1 Mo steel shifts the potential on the polarization curve at which a rapid increase in the current (which is indicative of crevice initiation) occurs to a lower value; in other words, the crevice corrosion resistance lowers. Especially in steel No. 3 which contains more than 0.3% sulfur, this tendency is remarkable. From this it follows that, while the addition of sulfur to the 26 Cr-1 Mo steel can improve the machinability of the steel, it sharply deteriorates the crevice corrosion resistance, thereby rendering the steel unfit for practical use.

Figure 2:
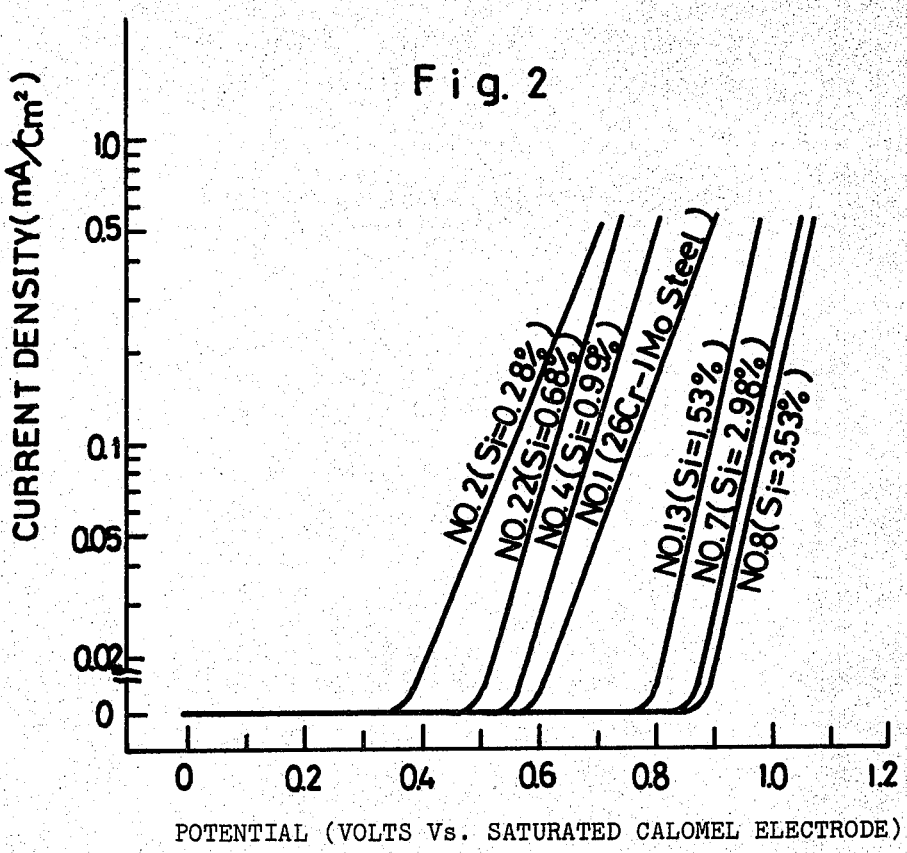

FIG. 2 illustrates the effect of an increased silicon content in a sulfur-containing 26 Cr-1 Mo steel upon its anodic polarization curve. As evident from FIG. 2, an increased silicon content in the steel causes the potential on the polarization curve corresponding to a rapid increase in the current to shift to a higher value. With the addition of above 1% silicon the potential reaches the same level as that of a 26 Cr-1 Mo steel with no sulfur addition, but with addition of about 3% silicon the tendency toward improvement decreases.

Figure 3:
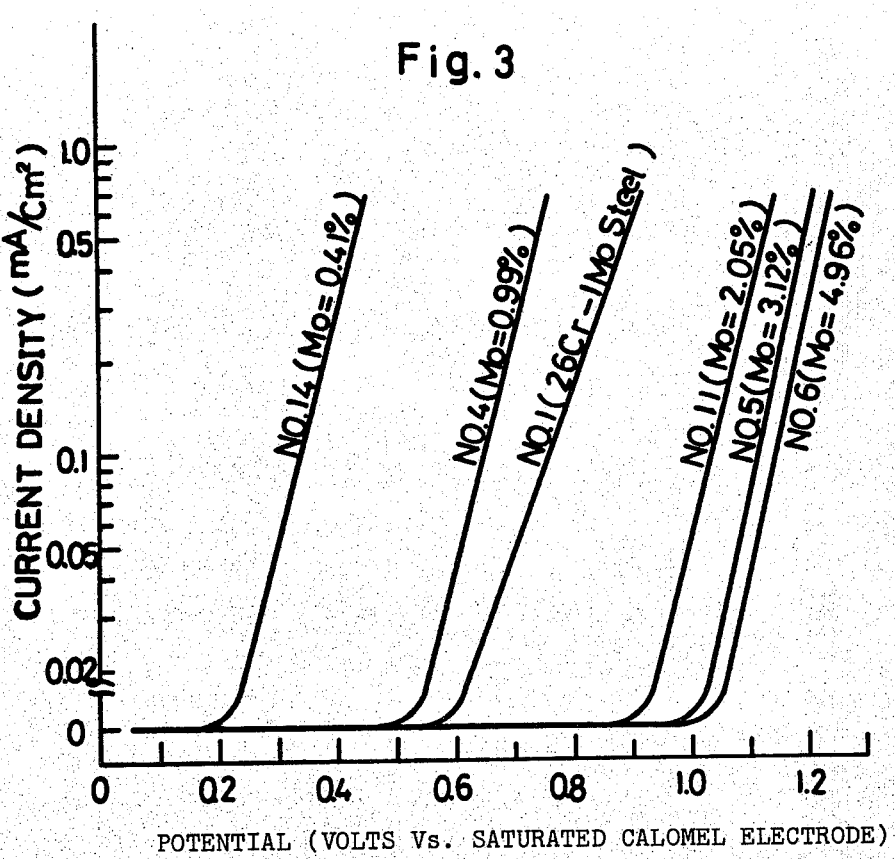

FIG. 3 illustrates the relation between the molybdenum content and the anodic polarization curve of a steel containing about 1% silicon according to the present invention. As evident from FIG. 3, with an increase in the molybdenum content, the potential on the polarization curve corresponding to a rapid increase in the current moves to a higher value.

Figure 4:
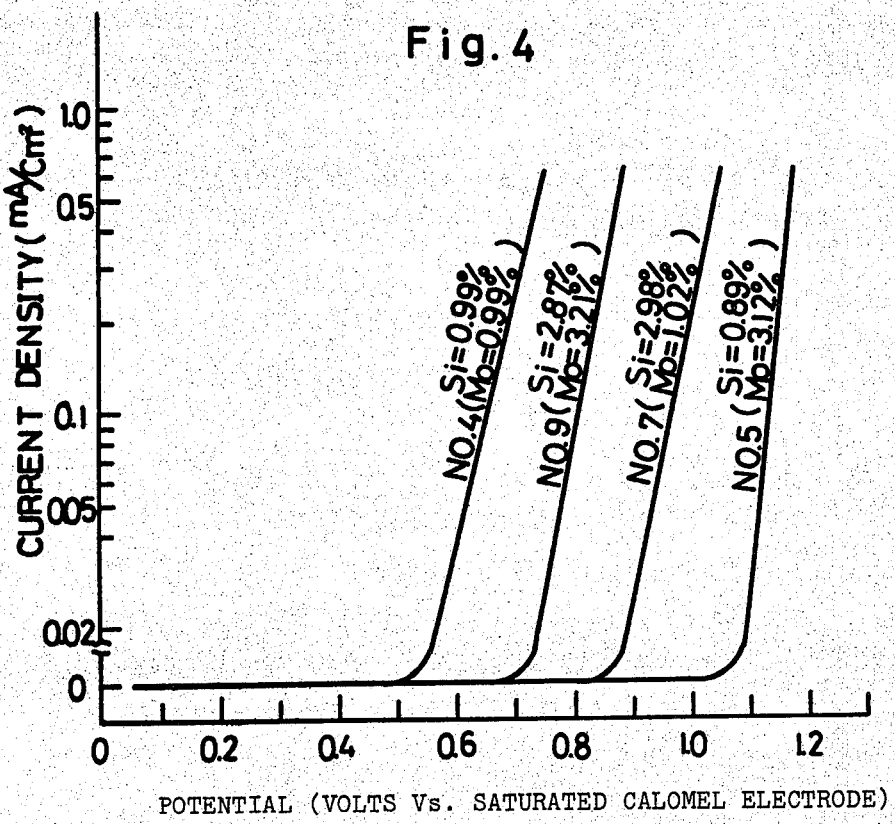

FIG. 4 summarizes the result of an experiment to determine whether or not any interaction occurs between molybdenum and silicon in a steel having more than 0.8% silicon according to the present invention. From FIG. 4 it is clear that interaction between molybdenum and silicon occurs. In steel No. 9 with about 3% molybdenum and about 3% silicon the potential corresponding to a rapid increase of the current rather tends to move to a lower value. Thus the optimum conditions in terms of crevice corrosion resistance for a steel according to the invention having no vanadium content would be about 3% molybdenum and about 1% silicon.

Figure 5:
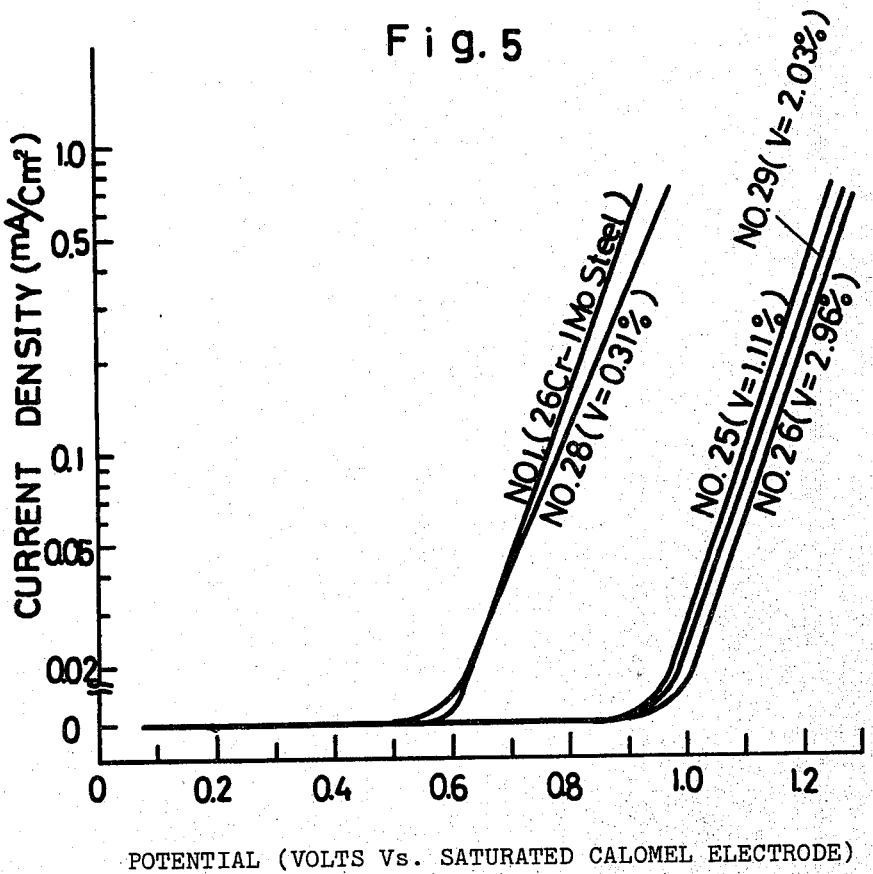

FIG. 5 next illustrates the effect of vanadium addition, with the silicon content set at about 0.5%, on the anodic polarization curve of a sulfur containing 26 1 Cr-1 Mo steel. From FIG. 5 it is clear that with an increase in the vanadium content, the potential corresponding to a rapid increase of the current on the polarization curve shifts to a higher value, reaching about the same level as that of a 26 Cr-1 Mo steel containing about 0.3% vanadium and no sulfur.

Figure 6:
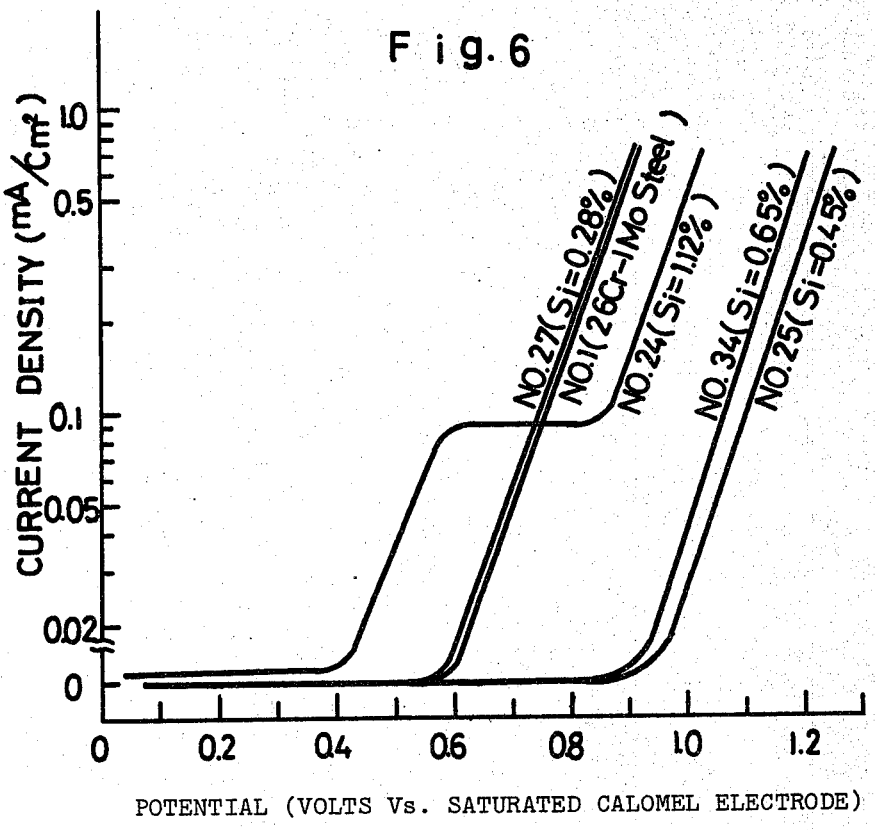

FIG. 6 illustrates the relationship between silicon content and the anodic polarization curve of a steel containing about 1% vanadium according to the present invention. From FIG. 6 it is clear that with an increase in the silicon content the potential corresponding to a rapid increase of the current on the polarization curve shifts to a higher value, but too much silicon has an adverse effect.

Figure 7:
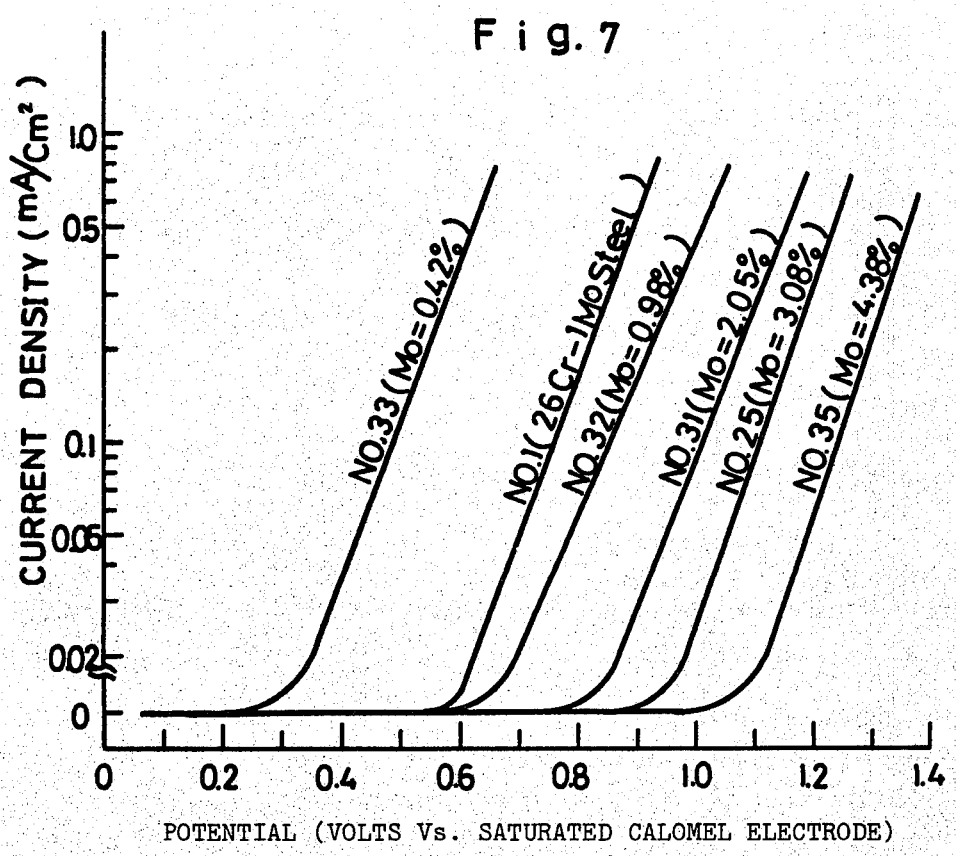

FIG. 7 illustrates the relationship between molybdenum content and the anodic polarization curve of a steel containing about 0.5% silicon and about 1% vanadium according to the present invention. As evident from FIG. 7, an increase in molybdenum content results in an improvement in the crevice corrosion resistance of steel. From these facts it follows that the optimum composition of a steel according to the invention having a vanadium content is: about 3% molybdenum, about 0.5% silicon and about 1% vanadium.

Table 2 summarizes the results of crevice corrosion tests on AISI316 (steel No. 23), i.e., a typical pitting-resistant austenitic stainless steel, on the reference steels, and on some of the steels according to the present invention.

TABLE 2

| | Weight loss (mg) | | |
|---|---|---|---|
| No. | Bar (diameter 15mm × length 20 mm) | Plate (thickness 5mm × 25mm × 25 mm) | Remark |
| 1 | 17.5 | 54.1 | |
| 2 | 112.6 | 316.3 | |
| 4 | 18.6 | 72.5 | |
| 5 | 0.9 | 34.8 | |
| 12 | 22.3 | 86.3 | |
| *15 | 0.8 | 30.9 | |
| *16 | 0.8 | 29.0 | |
| *17 | 0.9 | 28.7 | |
| *18 | 12.3 | 43.3 | |
| 19 | 9.2 | 40.8 | |
| 20 | 1.0 | 26.3 | |
| *21 | 0.8 | 27.7 | |
| 23 | 40.3 | 88.8 | AISI316 |
| *24 | 20.1 | 81.4 | |
| *25 | 1.2 | 2.1 | |
| *26 | 0.8 | 1.3 | |
| *28 | 16.5 | 53.0 | |
| *29 | 1.2 | 1.7 | |
| *37 | 1.0 | 4.1 | |
| *38 | 1.8 | 5.6 | |
| *39 | 1.4 | 3.8 | |
| *40 | 1.1 | 2.5 | |
| *41 | 1.3 | 3.9 | |
| *42 | 1.7 | 6.1 | |

(*are steels of the present invention)

The significance of these results will be better appreciated after consideration of the following extract from Table 2, which also shows the V and S contents of the steels, and the potential voltage at which crevice initiation begins to increase rapidly. Since this value tends to vary inversely with weight loss it constitutes another indication of corrosion resistance.

Extract from TABLE 2

| No. | V % | S % | Crevice Corrosion Potential Voltage relative to saturated calomal electrode at which rapid increase in current begins. | Chemical Corrosion Test weight loss (mg) Bar Dia:15mm Long:20mm | Plate Thick:5mm Wide:25mm Leng:25mm |
|---|---|---|---|---|---|
| 1 | — | 0.010 | 0.602 | 17.5 | 54.1 |
| 2 | — | 0.127 | 0.400 | 112.6 | 316.3 |
| 28 | 0.31 | 0.151 | 0.610 | 16.5 | 53.0 |
| 25 | 1.11 | 0.156 | 0.946 | 1.2 | 2.1 |
| 29 | 2.03 | 0.146 | 0.972 | 1.2 | 1.7 |
| 26 | 2.96 | 0.145 | 1.02 | 0.8 | 1.3 |

In this extract steel No. 1 is a 26 Cr-1 Mo steel. Steel No. 2 is a 26 Cr-1 Mo steel to which 0.127% S is added during manufacture. With the addition of S, it is clear that crevice corrosion potential voltage drops, while weight loss on crevice corrosion increases. However, the crevice corrosion potential voltage and weight loss on crevice corrosion of steel No. 28, i.e., 26 Cr-3 Mo steel which contains about 0.15% S and about 0.3% V are approximately the same as with the steel No. 1.

Next, the crevice corrosion potential voltage of 26 Cr-3 Mo steel (Steel Nos. 25, 29 and 26) containing about 0.15% S and 1-3% V is higher than that of the steel No. 28 and the weight loss on crevice corrosion decreases remarkably in comparison with that of the steel No. 28. From these facts, it is clear that the addition of V contributes to the improvement of corrosion resistance in steels.

In this crevice corrosion test the crevice was created by attaching an "O"-ring of synthetic rubber when the test specimen was a bar and by attaching a Teflon board to both sides of the test specimen, using Teflon bolts and nuts, when the test specimen was a plate. The bar specimen was immersed for 96 hours in a 2% ferric chloride solution at 35° C., and the plate specimen was immersed for 48 hours in the ferric chloride solution containing 50 g/l $FeCl_3.6H_2O$ at 35° C. Then the weight loss after immersion was measured.

As is apparent from Table 2, the steels according to the present invention are equal or remarkably superior to the 26 Cr-1 Mo steel having no sulfur (steel No. 1) or the AISI316 (steel No. 23), i.e., a typical austenitic stainless steel with respect to its crevice corrosion resistance.

Figure 8:
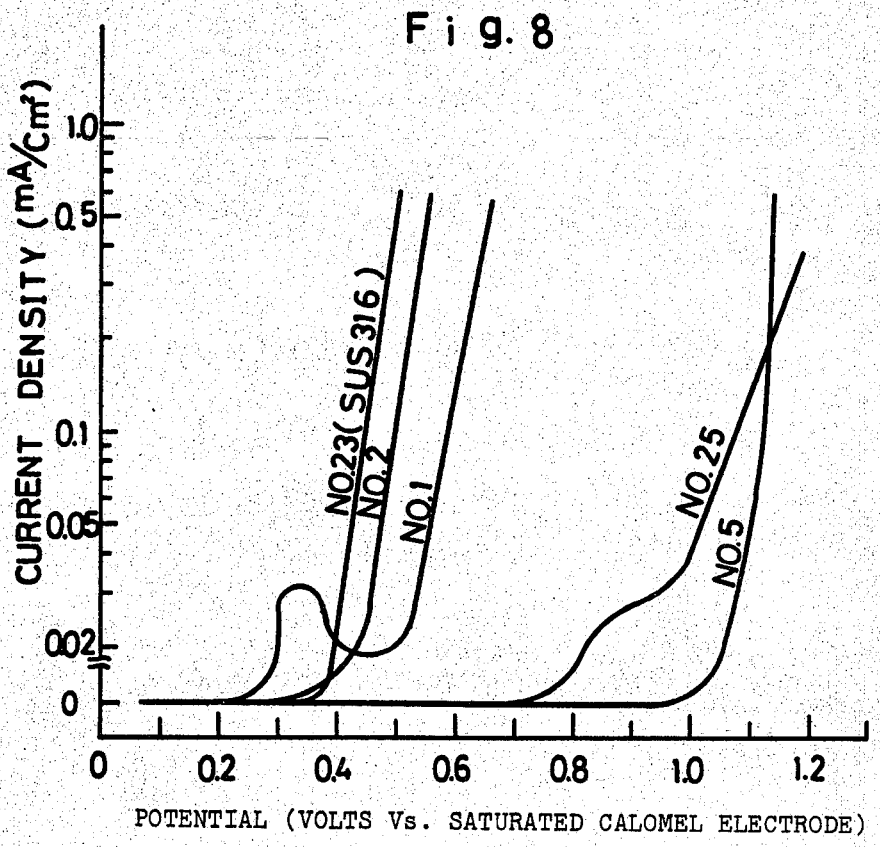
FIG. 8 shows the pitting potential of test specimens in a 3% sodium chloride solution (35° C.).

FIG. 8 summarizes the results of measuring the pitting potential of the steels according to the present invention to study their pitting resistance. For comparison, a 26 Cr-1 Mo steel (steel No. 1) a sulfur containing 26 Cr-1 Mo steel (steel No. 2) and AISI316 (steel No. 23) were used. As FIG. 8 shows, the steels according to the present invention exhibit a far higher pitting potential than any of the other steels compared and are found to be superior in pitting resistance.

Further, the selected test specimens were subjected to a machining test (turning) to measure the tool life, the results being summarized in Table 3. The conditions for this machining test were: Tool material: high speed tool Steels JIS G 4403 SKH 4A (approximately AISI-16); tool geometry: back rake angle 0°, side rake angle 15", end relief angle 7", side relief angle 7", end cutting edge angle 10°, side cutting edge angle 0° and nose radium 0.5 mm; feed: 0.12 mm/rev; cut depth: 0.1 mm; cutting speed: 70 m/min; cutting oil "NH-30"; estimation of tool life-time (min) until the tool becomes unable to cut due to meltdown.

As seen from Table 3, the tool life when cutting the steels according to the present invention is invariable long, testifying to the excellence of these steels in machinability.

TABLE 3

| No. | Tool Life (min) | No. | Tool Life (min) |
|---|---|---|---|
| 1 | 2.0 | *24 | 6.4 |
| *5 | 5.8 | 30 | 1.6 |
| 10 | 1.8 | 36 | 6.5 |
| 12 | 6.9 | *37 | 5.8 |
| *15 | 5.3 | *38 | 5.9 |
| *16 | 5.5 | *39 | 5.0 |
| *17 | 4.6 | *40 | 5.1 |
| 19 | 4.8 | *41 | 5.7 |
| 20 | 5.2 | *42 | 5.1 |
| *21 | 4.9 | | |

(*are steels according to the present invention)

Meanwhile, the same test specimens were tested for general corrosion resistance. As a result, all steels of the present invention were found equal or superior to the base steel, i.e., the 26 Cr-1 Mo steel (steel No. 1) in general corrosion resistance.

What is claimed is:

1. A ferritic stainless steel having excellent machinability and local corrosion resistance, consisting essentially of less than 0.020% carbon, less than 0.050% nitrogen, 0.4-0.7% silicon, less than 3.0% manganese, 23-28% chromium, 1.0-5.0% molybdenum, 0.3-3.0% vanadium, 0-5.0% nickel; and at least one element selected from the group consisting of 0.05-0.20% sulfur, 0.05-0.30% selenium, 0.05-0.30% tellurium, 0.01-0.20% lead, 0.01-0.20% bismuth, and 0.005-0.065% calcium, the balance being substantially all iron.

2. Steel as claimed in claim 1 containing 1-3% vanadium.

3. Steel as claimed in claim 1 containing 0.5-2.0% vanadium, and 1-4% molybdenum.

4. Steel as claimed in claim 1 containing 0.05-0.20% sulfur.

* * * * *